US005255869A

United States Patent [19]

Smith

[11] Patent Number: 5,255,869

[45] Date of Patent: Oct. 26, 1993

[54] IMPACT CRUSHER WITH BIASED TERTIARY CURTAIN ASSEMBLY

[76] Inventor: Roger G. Smith, 17693 SW. Blue Heron Rd., Lake Oswego, Oreg. 97034

[21] Appl. No.: 966,506

[22] Filed: Oct. 26, 1992

[51] Int. Cl.[5] ..... B02C 13/00

[52] U.S. Cl. ..... 241/189.1; 241/288; 241/289

[58] Field of Search ..... 241/189.1, 288, 289, 241/287

[56] References Cited

U.S. PATENT DOCUMENTS

| | | | |
|---|---|---|---|
| 1,872,233 | 8/1932 | Borton | 241/189.1 |
| 1,997,214 | 4/1935 | Guest | 241/289 X |
| 2,375,370 | 5/1945 | Krider | 241/289 |
| 2,891,734 | 6/1959 | Andreas | 241/289 |
| 3,150,837 | 9/1964 | Hanse et al. | 241/189.1 |
| 3,447,758 | 6/1969 | Oznobichine | 241/191 X |
| 3,659,794 | 5/1972 | Hemesath | 241/189.1 |
| 4,177,954 | 12/1979 | Ostreng | 241/189.1 X |
| 4,288,039 | 9/1981 | Waskow | 241/289 X |
| 4,729,517 | 3/1988 | Krokor et al. | 241/289 X |

*Primary Examiner*—Mark Rosenbaum
*Assistant Examiner*—Frances Chin
*Attorney, Agent, or Firm*—Kolisch Hartwell Dickinson McCormack & Heuser

[57] ABSTRACT

An improved crusher with first, second and third curtain assemblies. Each curtain assembly mounts a series of crusher plates and the plates of its curtain assemblies are distributed circumferentially above a rotor in the crusher. The three curtain assemblies pivot or swing about a common pivot axis. Gravity biases the third curtain assembly whereby the breaker plates are urged toward the rotor of the crusher. Springs and curtain rods are part of structure additionally biasing the third curtain assembly.

9 Claims, 3 Drawing Sheets

IMPACT CRUSHER WITH BIASED TERTIARY CURTAIN ASSEMBLY

BACKGROUND OF THE INVENTION

This invention relates to an impact crusher. More particularly, the invention concerns an impact crusher which includes primary and secondary curtain assemblies, each of which includes breaker plates which material impacts or is thrown against during the crushing operation, and which additional includes a tertiary curtain assembly acting on material after the material passes the primary and secondary assemblies.

A general object of the invention is to provide an improved impact crusher which incorporates primary, secondary and tertiary curtain assemblies, and which features a construction accommodating clearance-establishing movement in the tertiary curtain assembly as desirably should occur when an overloaded or jammed condition exists.

Yet another object is to provide an improved impact crusher, with a tertiary or exit curtain assembly, where release movement is established with pivoting of the curtain assembly about a suitably located pivot axis.

Yet a further object is to provide a construction where a tertiary curtain assembly is part of the curtain system, and where gravity is relied upon, at least in part, for biasing of the curtain assembly to establish a lowered operative position for the assembly.

A related object is to provide a construction which provides for adjustability in the lowered position for a curtain assembly.

Another related object is to provide a construction wherein biasing may be supplemented by springs acting in concert with gravity.

BRIEF DESCRIPTION OF THE DRAWINGS

These and other objects and advantages are attained by the invention, which is described hereinbelow in conjunction with the accompanying drawings, wherein.

DETAILED DESCRIPTION OF THE PREFERRED EMBODIMENT

Figure 1:
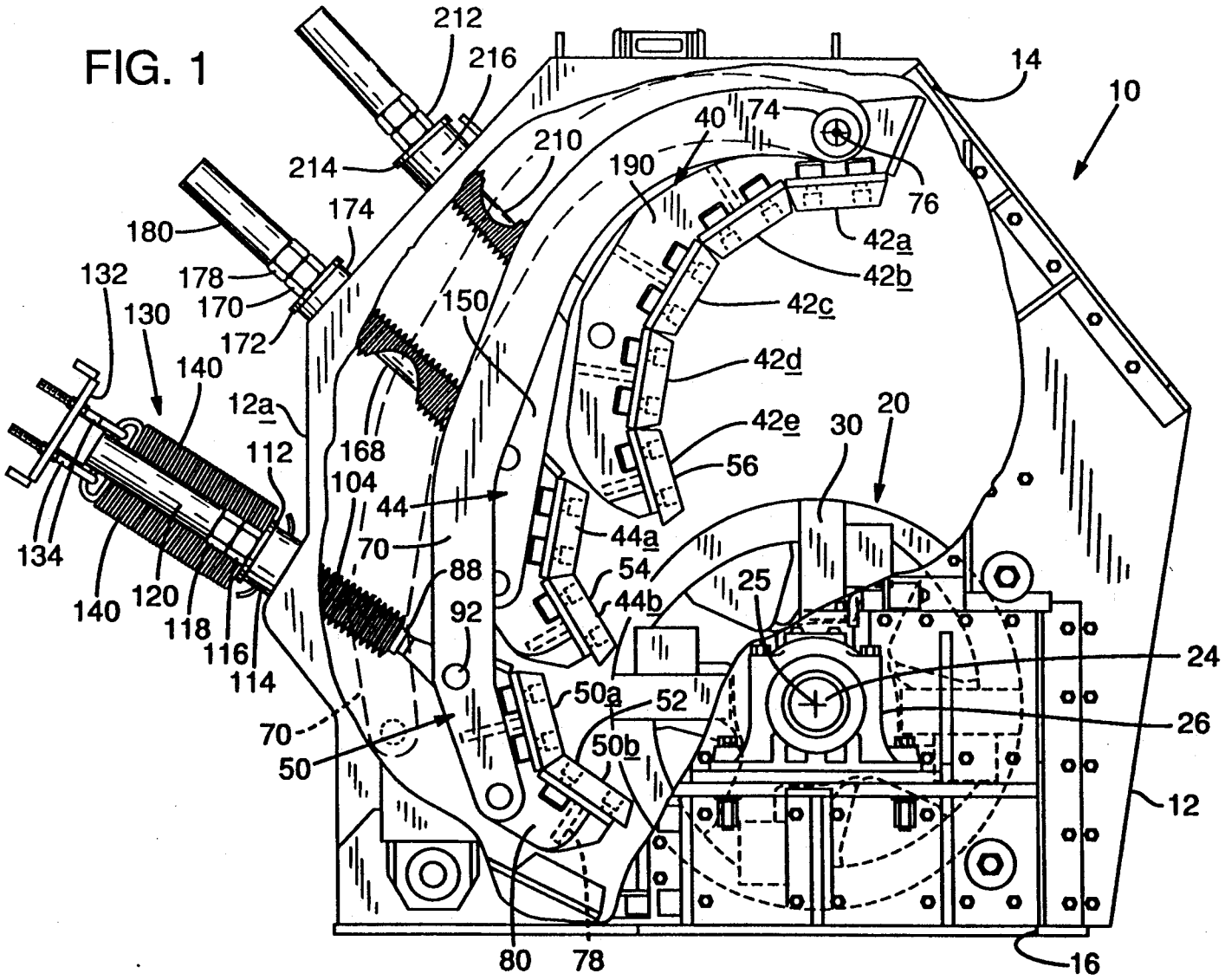
FIG. 1 is a side elevation, partially broken away, of a crusher constructed according to an embodiment of the invention.

Referring now to the drawings, and initially to FIG. 1, an impact crusher constructed pursuant to the invention is indicated generally at 10. The crusher includes a frame 12 with a hood 12*a* of the frame that extends about the top and sides of the crusher. The frame suitably supports the crusher on the ground. Material is fed into the crusher through infeed opening 14. Material exits the crusher through a discharge opening 16 at the base of the crusher.

Supported within the crusher is a rotor 20. The rotor includes a horizontal shaft or spindle 24 extending axially through its center, and this shaft has it ends suitably rotatably supported in bearings, such as those shown at 26. The rotor is rotated under power, through a suitable power-drive system connected to an end of the shaft. Rotation of the shaft is about its axis 25.

Suitably supported at points distributed circumferentially about the rotor are hammers 30. Rock or aggregate fed into the crusher through opening 14 cascades downwardly onto the rapidly rotating rotor, thence to be struck by the hammers which are moving in circular orbits about the axis of shaft 24. This material is thrown outwardly by the rotor.

The interior of the hood assembly which forms the frame forms a chamber essentially surrounding the rotor. The interior of this chamber is lined with the usual liner plates, which are conventional, and thus not illustrated.

Supported within the hood structure of the frame is a primary curtain assembly 40, which includes what is referred to herein as a curtain collectively formed by rows of breaker plates 42*a*, 42*b*, 42*c*, 42*d*, 42*e*. Also supported within the hood assembly of the frame is a secondary curtain assembly 44, supporting a curtain formed collectively of rows of breaker plates 44*a*, 44*b*. A tertiary or exit curtain assembly is illustrated at 50, which mounts rows of plates 50*a*, 50*b* forming a curtain assembly adjacent the base of the hood interior.

With operation of the crusher, as already discussed, material fed into the crusher cascades downwardly against the rotor and thence is impacted and thrown outwardly on being struck by the hammers in the rotor. Much of such material initially is thrown outwardly against the primary curtain assembly, with impacting of material and particle size reduction. Such is returned to the rotor, by rebounding off the curtain assembly. Material on working past the primary curtain assembly, usually of a smaller size on being impacted by the hammers in the rotor, is thrown outwardly against the secondary curtain assembly and its rows of breaker plates 44*a*, 44*b*. This material, again, rebounds or falls by gravity to return to the rotor.

It will be noted, and with continued reference to FIG. 1, that the faces of the breaker plates in tertiary or exit curtain assembly 50, and in particular faces 52 of plates in row 50*b*, incline at a much slighter angle relative to horizontal then do faces 54 and 56 in the rows of breaker plates in the primary and secondary curtain assemblies. Further, as compared to the breaker plates in the primary and secondary curtain assemblies, the breaker plates in the tertiary curtain assembly are relatively low in the housing. Further explaining, row 50*a* of the plates in assembly 50 is approximately at the level of the axis of shaft 24 in the rotor, and row 50*b* in assembly 50 is below this level. It should further be remembered that material on being operated upon by the tertiary curtain assembly has already been reduced in size to a substantial extent by impacting of the hammers in the rotor and striking the curtains in the primary and secondary curtain assemblies. As a consequence, the kinetic energy of material thrown against the breaker plates of the tertiary curtain assembly is substantially less than that of material being operated upon in regions higher in the crusher. All these factors contribute to an operation, in the tertiary curtain assembly, which in many respects resembles a grinding operation, in comparison to the impacting type of action of the primary and secondary curtain assemblies.

Figure 4:
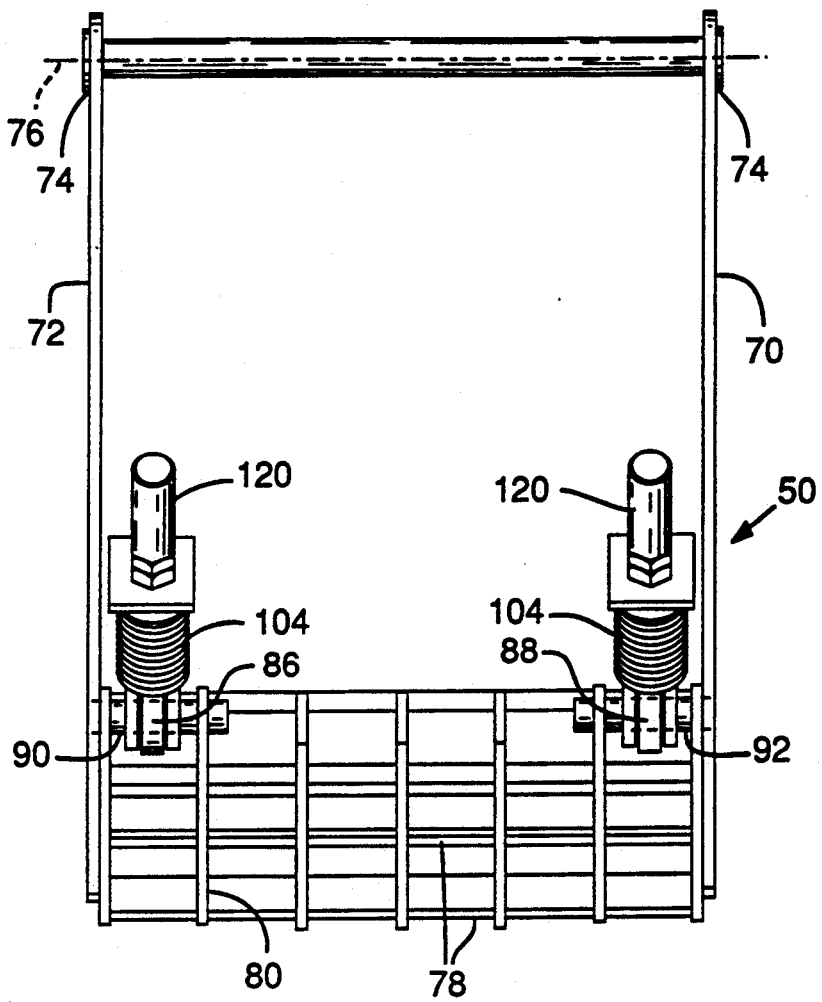
FIG. 4 illustrates the tertiary curtain assembly in the crusher, looking at the back of the assembly and with the assembly removed from the crusher.

Considering details of the construction of exit or tertiary curtain assembly 50, and referring to FIGS. 1 and 4, such includes on opposite sides of the assembly, a pair of elongate pivot arms 70, 72. These arms, which constitute arm structure in the assembly, have pivot mountings 74 pivotally supporting the arms for pivotal movement about a horizontal axis, indicated at 76. This axis parallels rotor rotation axis 25, and is directly adjacent the upper margin of intake opening 14 for material being fed into the crusher. These arms, together with strong backs 78 and weldments 80, are all joined together to provide a rigid unit supporting the plates in rows 50*a*, 50*b*.

Figure 5:
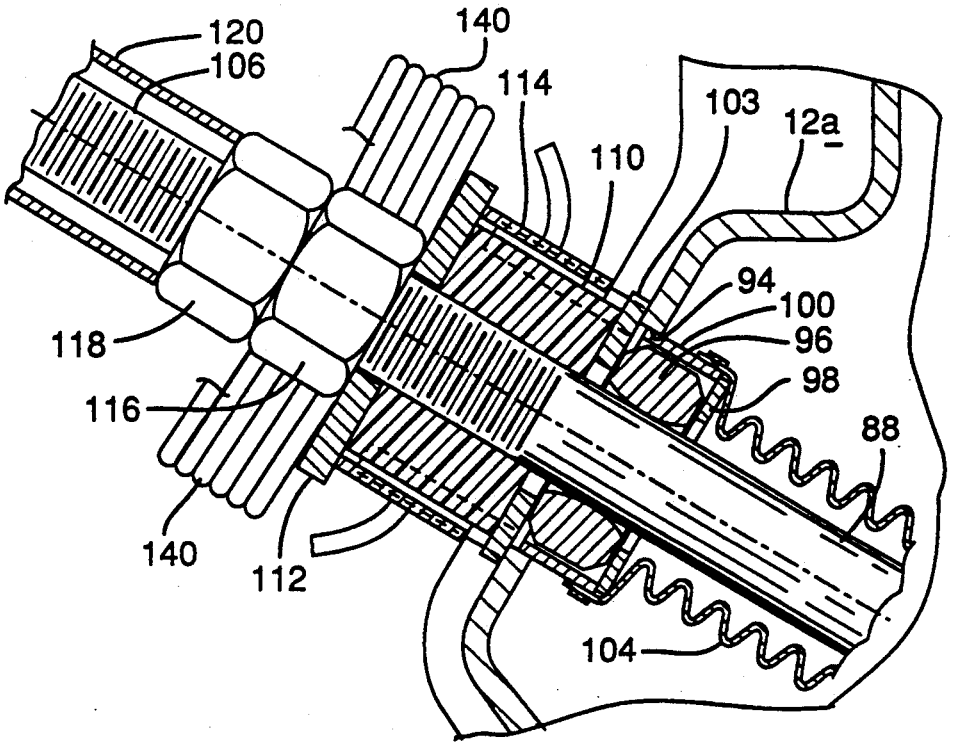
FIG. 5 is an enlarged view, with portions broken away, showing a part of curtain rod structure provided in the tertiary curtain assembly.

Curtain rods 86, 88 are pivotably mounted at 90, 92 to the back of the arm structure in the curtain assembly. Referring now also to FIG. 5, these extend out through holes, such as hole 94, in the hood structure. Each curtain rod is provided with a guide bushing, which may be made of nylon and is shown at 96, mounted adjacent hole 94. Encasing the guide bushing is a washer 98 and a cylinder segment 100. These are welded to each other, and segment 100 is secured, as by welding, to the hood structure on its under side. A retaining plate 103 is suitably secured to hood 12*a*, and this retaining plate confines the upwardly facing side of guide bushing 96.

A dust cover 104 has one end anchored to cylinder segment 100 and its opposite end anchored to the curtain rod adjacent where the rod is pivotably connected to the arm structure of the curtain assembly.

The curtain rod is threaded as at 106. Snugly mounted on the curtain rod, but moveable along the rod, is an elastomer (such as a polyurethane) bumper 110. Encasing the bumper are a washer 112 and cylinder segment 114. The cylinder segment and washer are joined together, as by welding.

Screwed onto the threaded end of the curtain rod is a nut 116. This nut may be joined, as by welding, to washer 112. The structure described functions as an adjustable stop structure, with the position of nut 116 on the curtain rod determining the relative position of the bumper on the rod, and the position of the bumper when it comes up against retaining plate 103 to define the lower limit position for the curtain rod. This defined lower limit positioned for the curtain rod determines the defined lower limit position for the tertiary curtain assembly.

A lock nut is shown at 118. Curtain rod cover 120 secured to the locked nut serves to cover and protect the protruding end of the curtain rod.

The center of gravity of the tertiary curtain assembly just described is approximately midway along the length of the arms between the pivot mountings for the curtain rods and pivot axis 76 for the assembly. Thus, the pivot mounting for the curtain assembly, in a horizontal direction is spaced well toward the rotor from the center of gravity for the curtain assembly. As a consequence, gravity functions to bias the curtain assembly, urging the same to swing downwardly and in a counterclockwise direction in FIG. 1. Gravity thus urges the assembly to its lower limit position as determined by the stop structure just described.

The curtain assembly is yieldable, however, with the rows of breaker plates swinging rearwardly and upwardly from their lowered position, and with swinging of the curtain assembly about the fixed pivot axis 76 provided by pivot mounting 74. Such yieldable movement in the curtain assembly is desirable, as when overloading of rows of breaker plates 50*a*, 50*b* occurs, such as might occur, for instance, by reason of excessive accumulation of material on the breaker plates, or by reason of oversized material reaching the region between the rows of plates and the rotor. With an overloaded condition eliminated, the arm structure and rows of breaker plates making up the exit curtain assembly may freely swing downwardly about axis 76, with return of the exit curtain assembly to its lower limit position.

Figure 3:
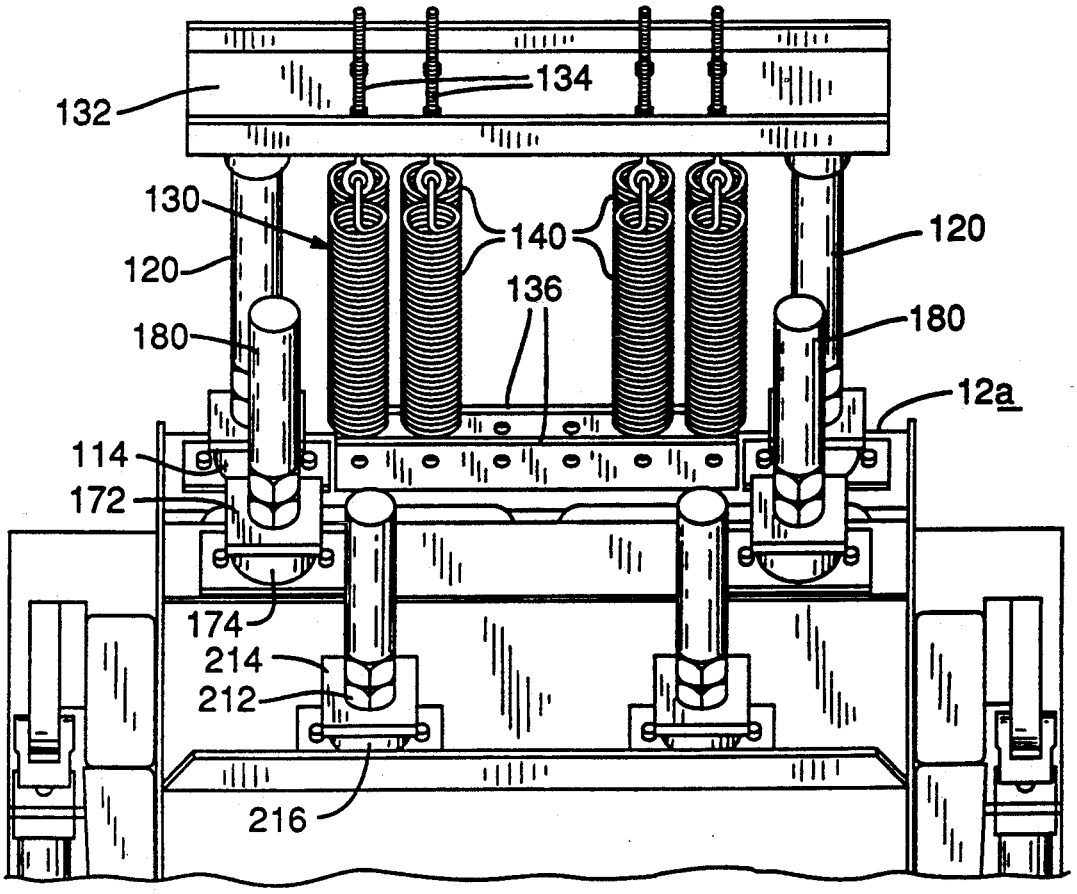
FIG. 3 is a view looking downwardly at rear portions of the crusher illustrated in FIG. 1.

Assisting gravity in biasing the curtain assembly to its lower limit position is spring mechanism shown at 130. Specifically, and referring to FIGS. 1 and 3, secured to the upper ends of rod covers 120, and spanning the space between them, is an elongate bar 132. Multiple spring anchors 134 are secured to this bar. Operatively secured to the hood structure are bars 136. Interspersed between spring anchors 134 and bars 136 are multiple coil springs 140.

The tension in the coil springs functions to draw bar 132 downwardly and toward the hood structure. This produces a corresponding movement in the curtain rod covers, with urging of stop nut 116 downwardly to move bumper 110 firmly against retaining plate 103.

Secondary curtain assembly 44 includes support arms such as arm 150 extending along opposite sides of the apparatus within the interior of the hood structure. These support arms, together with suitable strong backs and weldments, provide a unified support for the breaker plates in rows of breaker plates 44*a*, 44*b*.

The upper ends of arms 150 are pivotably mounted by pivot mounts adjacent the top of the machine and the upper margin of the entrance opening to the apparatus. The pivot axis provided by these pivot mounts coincides with axis 76 provided for the pivoting of the tertiary curtain assembly.

Curtain rods, exemplified by rod 168, have one set of ends pivotably mounted on the arm structure. The rods project rearwardly from the arm structure and outside of the hood. A nut 170 joined to a washer 172 and cylindrical segment 174 position a bumper similar to bumper 110 that defines a lower limit position for the curtain assembly. A lock mount is shown at 178, and a rod cover at 180 which is secured to the lock nut.

Figure 2:
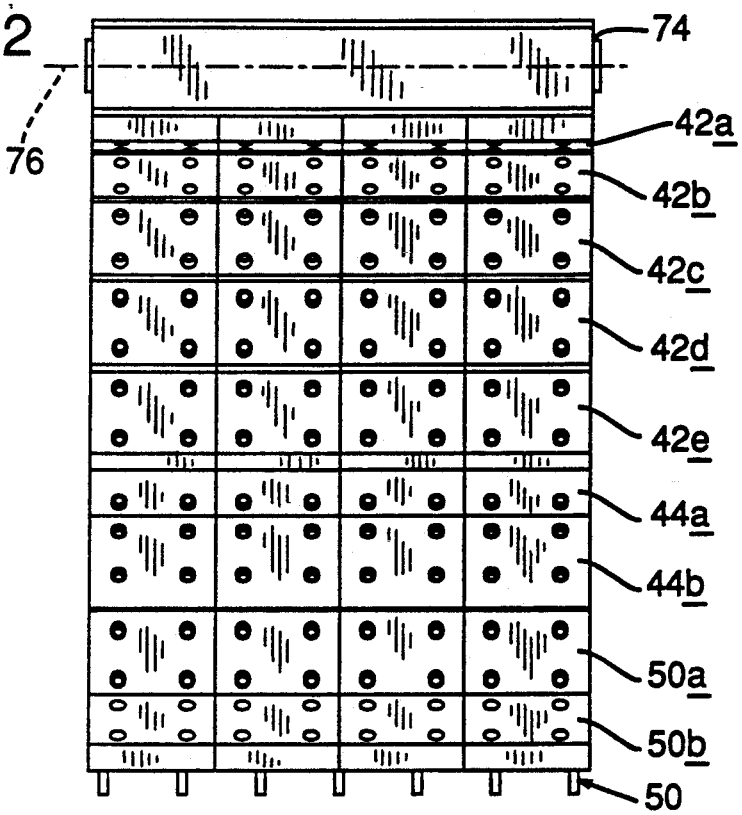
FIG. 2 is a view of faces of curtain assemblies in the crusher as they appear viewing from right to left in FIG. 1.

The center of gravity of the secondary curtain assembly is located, in a horizontal direction, well toward the rotor from rows of breaker plates 44*a*, 44*b*. As a consequence, gravity functions to urge the secondary curtain assembly in a counterclockwise direction in FIG. 2 to place it in its lower limit position.

The primary curtain assembly, like the secondary assembly, includes opposed support arms as exemplified by arm 190. These arms, together with suitable strong backs, are joined together and form a unified structure providing support for rows of plates 42*a*, 42*b*, 42*c*, 42*d*, 42*e*.

Curtain rods, such as rod 210, pivotally supported in the arm structure project rearwardly and through the hood. Screwed onto each of these rods is a nut 212. This nut, together with washer 214 and cylindrical segment 216, and an enclosed bumper, define a lower limit position for the curtain assembly.

The support arms 190 in the curtain assembly are pivotally mounted by pivot mounts for pivotal movement about an axis which coincides with axis 76. Thus, pivotal movement occurs, as in the case of the other curtain assemblies, about a pivot axis disposed upwardly from the rotor and forwardly in the hood structure adjacent the upper margin of the entrance opening to the apparatus.

As in the case of the secondary curtain assembly, the pivot mounting for the primary curtain assembly is disposed, in a horizontal direction, well forwardly toward the rotor from the center of gravity of the curtain assembly. Thus, gravity functions to bias the curtain assembly downwardly to its lower position defined by bumpers striking frame structure of the hood.

Operation of the impact crusher should be obvious. Material to be processed is introduced into the crusher through infeed opening 14. This material cascades downwardly inside the apparatus to fall upon the power-driven rotating rotor which is rotated under power, and in a counterclockwise direction as the rotor is illustrated in FIG. 1.

Such material is struck by the hammers which are moved by the rotor in circular orbits about the axis of the rotor. Crushing occurs, together with the material being thrown outwardly to impact the breaker plates of the primary curtain assembly and, on progressing further downwardly in the machine, the breaker plates of the secondary curtain assembly.

Final pulverizing of the material occurs as the material progresses downwardly to be thrown against rows of plates 50*a*, 50*b* of the exit or tertiary curtain assembly. More than with the other curtain assemblies, pulverizing of material with the tertiary curtain assembly occurs by reason of a grinding action occurring as the material is collected on the rows of breaker plates and forced downwardly by the rotating rotor.

In the event of overloading of the tertiary curtain assembly, by reason of oversized material forced between the rotor and the rows of breaker plates, or for any other reason, the curtain assembly may swing rearwardly and upwardly about pivot axis 76, with this movement resisted by gravity and also the biasing action of coil springs. During this movement, the bumpers which limit downward movement of the curtain assembly are free to move rearwardly and away from the hood structure of the machine. With passage of the oversized material in the curtain assembly, the curtain assembly is free to return to its lower limit position as defined by the bumpers striking the rear of the hood structure.

The apparatus described is reliable in operation and operates to produce a consistently sized material rapidly and efficiently.

While a particular embodiment of the invention has been described, obviously variations and modifications are possible. It is desired to cover all such modifications and variations that come within the scope of the invention.

It is claimed and desired to secure by Letters Patent:

1. In an impact crusher having a frame and a rotor rotatably supported on the frame for rotation about a rotor rotation axis, with hammers on the rotor for striking material, the improvement comprising:

primary and secondary curtain assemblies disposed above the rotor at locations spaced circumferentially thereabout, a tertiary curtain assembly extending downwardly beyond the secondary curtain assembly, said tertiary curtain assembly including a breaker plate structure spaced outwardly of the rotor and for contacting material moved thereagainst by the rotor and a pivot arm structure mounting the breaker plate structure, and a pivot mounting for the tertiary curtain assembly pivotally supporting the pivot arm structure for movement about a pivot axis disposed above the breaker plate structure and spaced in a horizontal direction toward a vertical line perpendicular to the rotation axis of the rotor from the center of gravity of the tertiary curtain assembly, whereby a gravity biasing of the tertiary curtain assembly toward the rotor is produced.

2. The crusher of claim 1, wherein the primary and secondary curtain assemblies each include pivot arms pivotally mounting the assembly for pivotal movement about said pivot axis.

3. The crusher of claim 1, and further including stop structure defining a lower limit position for the tertiary curtain assembly, gravity serving to bias the tertiary curtain assembly to said limit position.

4. The crusher of claim 3, wherein said pivot axis for the tertiary curtain assembly is a fixed pivot axis, and the tertiary curtain assembly is freely pivotable about said pivot axis at least to enable doubling of the spacing between the breaker plate structure and the rotor.

5. The crusher of claim 3, wherein the stop structure is adjustable, with adjustment of the stop structure serving to adjust the location of said lower limit position.

6. The crusher of claim 3, wherein the stop structure comprises an elastomer bumper and a stop shoulder engaged by the bumper and the bumper is freely movable away from the stop shoulder with movement of the tertiary curtain assembly away from the rotor.

7. The impact crusher of claim 3, which further includes biasing spring means operatively connected to the tertiary curtain assembly urging the assembly to said limit position.

8. The impact crusher of claim 3, and which further comprises plural curtain rods pivotably connected to the tertiary curtain assembly at points distributed in a direction paralleling the pivot axis of the curtain assembly, a bar interconnecting ends of the curtain rods, and coil springs interposed between the frame and said bar biasing the tertiary curtain assembly in a direction towards said limit position.

9. In an impact crusher:

a frame, a rotor journaled on the frame for rotation about a horizontal rotor rotation axis and the rotor having a perimeter, first, second and third curtain assemblies, each including breaker plate means, and the curtain assemblies being disposed with their said breaker plate means distributed circumferentially about the perimeter of the rotor, the rotor having a top and the breaker plate means of said first curtain assembly being adjacent the top of the rotor, the breaker plate means of said second curtain assembly being disposed downwardly from the breaker plate means of the first assembly, and the breaker plate means of the third assembly being disposed downwardly from the breaker plate means of the second assembly, and pivot arms pivotally mounting each of the curtain assemblies for pivotal movement about a horizontal pivot axis, and this pivot axis being the same for all the curtain assemblies, said pivot axis being located in a horizontal direction toward a vertical line perpendicular to the rotation axis of the rotor from the center of gravity of each curtain assembly.

* * * * *